US008453872B1

(12) United States Patent
Holmes

(10) Patent No.: US 8,453,872 B1
(45) Date of Patent: Jun. 4, 2013

(54) TRASH CONTAINER HANDLE

(76) Inventor: James Ivan Holmes, Menifee, CA (US)

( * ) Notice: Subject to any disclaimer, the term of this patent is extended or adjusted under 35 U.S.C. 154(b) by 0 days.

(21) Appl. No.: 13/470,263

(22) Filed: May 12, 2012

Related U.S. Application Data

(63) Continuation-in-part of application No. 13/068,548, filed on May 13, 2011, now Pat. No. 8,251,248.

(51) Int. Cl.
*B65D 25/10* (2006.01)
*B65D 53/00* (2006.01)
*B65D 81/24* (2006.01)

(52) U.S. Cl.
USPC ..... 220/759; 16/425

(58) Field of Classification Search
USPC ..... 220/752, 757, 759, 766, 769; 280/47.131, 280/47.315, 47.371; 224/555; 16/425–427; 15/257.7
See application file for complete search history.

(56) References Cited

U.S. PATENT DOCUMENTS 3,376,986 A * 4/1968 Farber ..... 414/446
4,807,916 A * 2/1989 Erickson ..... 294/15
6,651,992 B1 * 11/2003 Smith, Sr. ..... 280/47.26
D519,702 S * 4/2006 Boxhorn ..... D34/10
8,251,248 B1 * 8/2012 Holmes ..... 220/759
2011/0095061 A1 * 4/2011 Tortumlu ..... 224/555

FOREIGN PATENT DOCUMENTS

GB 2275035 A * 8/1994

* cited by examiner

*Primary Examiner* — Harry Grosso
(74) *Attorney, Agent, or Firm* — Loyal McKinley Hanson

(57) ABSTRACT

An apparatus for facilitating manual movement of a trash container having an upwardly opening container component with a pair of handles, a set of wheels, and a lid, includes an elongated apparatus or "tool" for the user to attach to the handles. A mid section of the tool engages the handles, an upwardly extending upper section provides a lever arm for the user to grasp, and a downwardly extending lower section contacts the container component in opposition to pivotal movement of the object about the handle axis. Preferably, a lid-restraining section is included that restrains pivotal movement of the lid about its hinges when the trash container is tilted on the wheels and moved. One embodiment includes pivotable hooks that facilitate hook engagement of the trash container handles.

1 Claim, 12 Drawing Sheets

TRASH CONTAINER HANDLE

CROSS REFERENCE TO RELATED APPLICATION

This application is a continuation in part of copending U.S. patent application Ser. No. 13/068,548 filed May 13, 2011.

BACKGROUND OF THE INVENTION

1. Technical Field

This invention relates generally to trash containers and the like, and more particularly to an apparatus for facilitating manual tilting and movement of a wheeled trash container.

2. Description of Related Art

The term "trash container" herein includes any of various cans, bins, barrels, receptacles, curbside containers, yard waste carts, and other containers for temporarily storing trash, waste, refuse, rubbish, garbage, litter, and the like. A typical wheeled trash container includes a rigid, 32-gallon to 96-gallon plastic container component, a lid component atop the container component, a handle assembly that forms a pair of spaced-apart handles on the container component, and a set of wheels on a common rotational axis at a lower portion of the container component. After trash has been collected in the container component, a user moves the trash container by closing the lid, grasping the handles, tilting the container rearwardly toward the user on the wheels, and then wheeling the trash container to a desired position alongside the curb for trash pickup (something like the operation of a typical wheeled appliance dolly).

Although wheeled trash containers have become a common household device for trash management, users often experience various problems in moving existing trash containers. First, a fully loaded container can require significant strength for the tilting operation. In addition, the container can roll out of control during the tilting operation if the user does not maintain a proper grip and balance. Furthermore, the lid can fall toward the user during the tilting operation, especially when the container is overfull. Moreover, the user must remain relatively close to the container and bent over sufficiently to maintain their grip on the handle, an awkward position at best. And, this position must be maintained, in large part, as the user pushes or pulls the trash container to the curb and sets it upright. For these reasons, there exists a need for a better way of manually moving a trash container.

SUMMARY OF THE INVENTION

In view of the foregoing, it is an object of the present invention to provide a way to alleviate the above-described concerns. The present invention achieves this objective by providing an apparatus that the user can mount on the handle of an existing trash container for better leverage. The apparatus mounts on (e.g., hooks onto) the pair of handles of an existing trash container to facilitate the trash can moving operation with an upwardly extending lever arm and, preferably, a lid controlling bracket. The lever arm facilitates the tilting operation while the bracket keeps the lid from falling toward the user.

To paraphrase some of the more precise language appearing in the claims and further introduce the nomenclature used, an apparatus constructed according to the invention for facilitating manual movement of a wheeled trash container includes an elongated tool a user attaches to the pair of handles of the trash container for container-moving purposes. A mid section of the tool functions as means for engaging the pair of handles. An upper section of the tool extends upwardly from the mid section and functions as a lever arm for the user to grasp instead of the pair of handles. A lower section of the tool extends downwardly from the mid section alongside the container component in a position to contact the container component in opposition to pivotal movement of the tool about the handle axis. Preferably, a lid-restraining section of the tool extends from the mid section over at least a portion of the lid and functions as means for restraining pivotal movement of the lid about the hinge arrangement. Operationally, the user attaches the mid section of the tool to the trash container, grasps the upper section, and then tilts the trash container on the set of wheels for container-moving purposes.

Thus, the invention provides an apparatus that the user can readily mount on the handles of an existing trash container to facilitate the trash-can moving operation. The apparatus distributes the weight more evenly. In addition, it results in more distance between the user and the trash container so that the trash container does not hit the user's feet when the user is moving the trash container. Furthermore, the apparatus provides better leverage for tilting the trash container, and the apparatus enables the user to tilt the trash container without having to carefully balance it. Beyond that, if the trash container is overly full, the apparatus helps keep the lid shut while the user moves the trash container. The following detailed description and accompanying illustrative drawings make the foregoing and other objects, features, and advantages of the invention more apparent.

DESCRIPTION OF THE PREFERRED EMBODIMENTS

FIGS. 1 and 3-8 of the drawings show various details of an apparatus 10 constructed according to the invention. A user 11 (FIGS. 5, 6, 7, and 8) uses the apparatus 10 to manually move a typical prior art trash container 12 that is illustrated by itself in FIG. 2. The user 11 attaches the apparatus 10 on the trash container 12 and uses it to help tilt and move the trash container 12.

Figure 2:
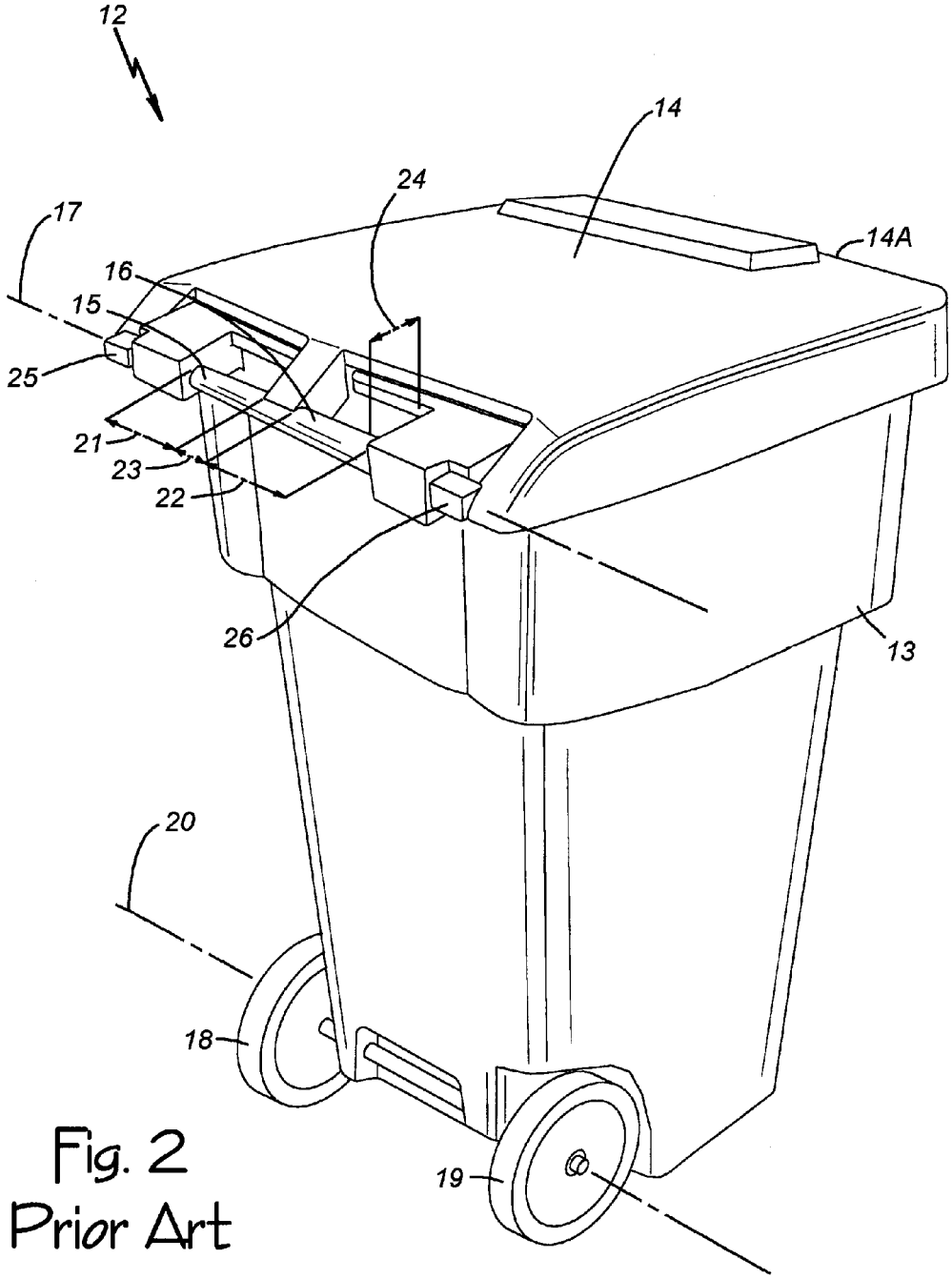
Fig. 2 Prior Art
FIG. 2 of the drawings is a perspective view of a portion of a typical prior art trash container that a user can move manually with the trash container handle apparatus.

First consider the prior art trash container 12 in FIG. 2. It represents any of various known existing trash containers and the like in which a user temporarily collects trash for later pickup and disposal, including, for example, a 96-gallon, plastic, wheeled rollout refuse cart available from Toter, Incorporated of Statesville, N.C. under the TOTER trademark. As such, the trash container 12 includes, a container component 13, a lid 14 atop the container component 13, a pair of spaced-apart tubular handles on the container component 13 (i.e., a first or left handle 15 and a second or right handle 16) that are aligned along a handle axis 17, and a set of wheels on the container component 13 (i.e., a first or left wheel 18 and a second or right wheel 19 that are mounted on the container component 13 for rotation about a common rotational axis or wheel axis 20).

As an idea of size, the trash container 12 stands about 45 inches high in overall height, with the container component 13 having a capacity of about 96 gallons. Each of the handles 15 and 16 is about 5.5 inches long measured along the handle axis 17 as indicated by dimensions 21 and 22 in FIG. 2, with the handles being separated by about 1.75 inches as indicated by a dimension 23. In addition, the handles are tubularly shaped with an outside diameter of about 1.25 inches and they are spaced apart from the container component 13 by about 1.75 inches as indicated by a dimension 24 in FIG. 2. Of course, those dimensions may vary significantly from one trash container to the next without affecting the inventive concepts described herein.

To lift the lid 14 in order to place trash in the container component 13, a user grasps and lifts a forward edge portion 14A of the lid 14, thereby causing the lid 14 to pivot about a pair of left and right hinge components 25 and 26. To manually move the trash container 12 from one location to another, as commonly done heretofore without the benefit of the instant invention, a user first grasps the left and right handles 15 and 16 and pulls on them to tilt the trash container 12 on the wheels 18 and 19, tilting it from the normal upright position on level ground illustrated in FIG. 2 toward the user (i.e., pivoting the trash container 12 about the wheel axis 20). With the trash container 12 tilted toward the user that way, the user pushes against the handles 15 and 16 in order to thereby cause the trash container 12 to move on the wheels 18 and 19 toward the direction the user is facing. After pushing the trash container 12 to a desired location in the manner described above, the user carefully lowers the trash container 12 back down to its normal upright position by allowing the trash container 12 to pivot about the wheel axis 20 under influence of gravity.

Figure 1:
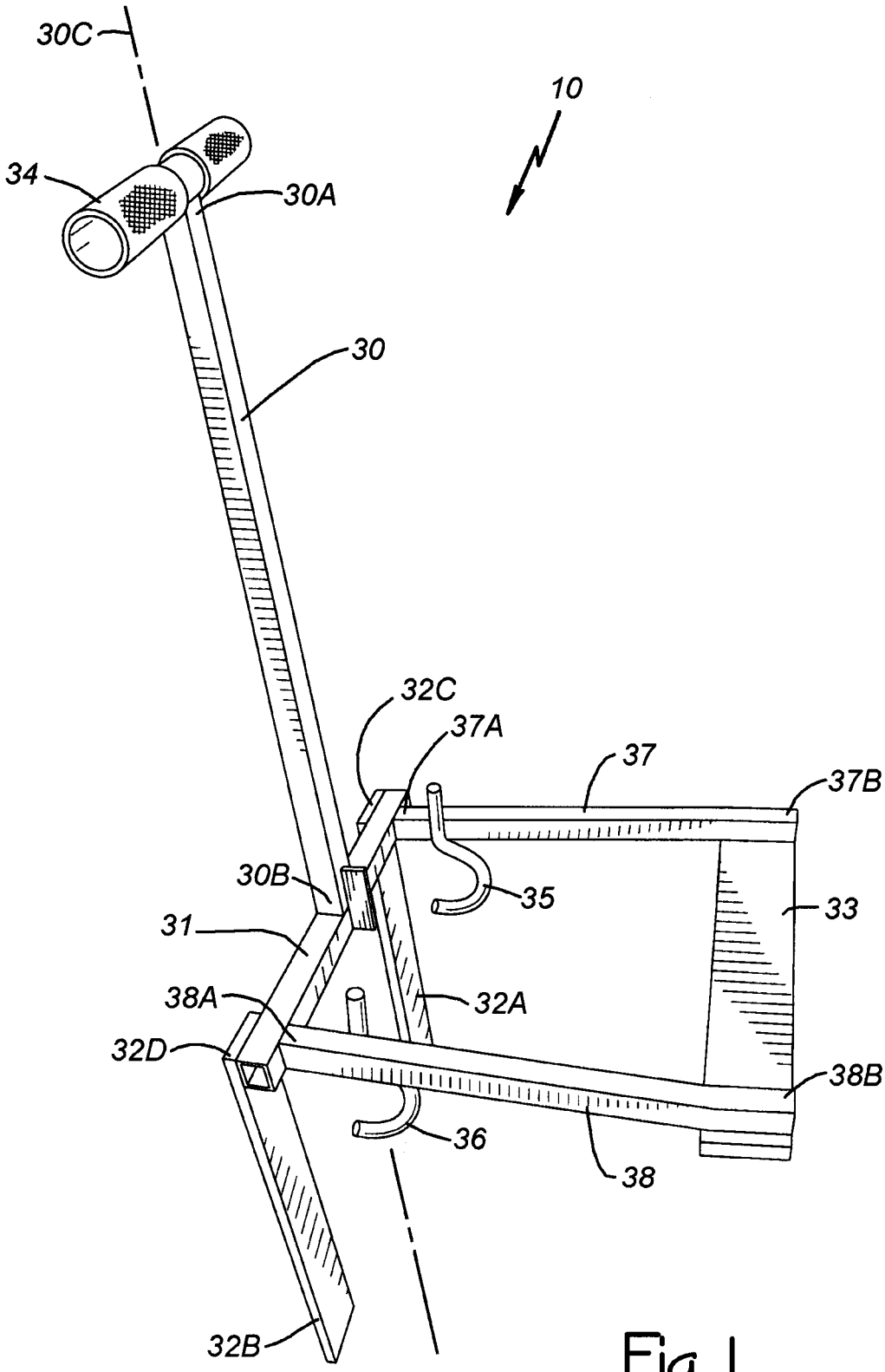
FIG. 1 of the drawings is a perspective view of a first embodiment of a trash container handle apparatus (i.e., "tool") constructed according to the present invention.

Now, with the foregoing structural and operational details of an existing trash container 12 in mind, consider the apparatus 10 in further detail with reference to FIG. 1. It includes an elongated member 30, a cross member 31, pivot-limiting pieces 32A and 32B, and a lid-restricting piece 33. The elongated member 30 (e.g., a two-foot long piece of ¾-inch hollow square steel tubing) has a first end 30A, a second end 30B opposite the first end 30A, and an axis of elongation 30C extending between the first and second ends 30A and 30B. A knurled handle member 34 on the first end 30A (e.g., an eight-inch long section of 1.25-inch outside diameter cylindrical tubing with a knurled outer surface) extends perpendicular to the axis of elongation 30C as a handle the user 11 can grasp when using the apparatus 10.

The cross member 31 (e.g., a thirteen-inch long piece of ¾-inch hollow square steel tubing) is welded or otherwise suitably attached to the second end 30B of the elongated member 30 as a support for two hook members (i.e., a first or left hook 35 and a second of right hook 36). The hook members 35 and 36 (e.g., two-inch inside diameter steel hooks) are welded or otherwise suitably attached to respective ones of a first or left arm 37 and a second or right arm 38, with the proximal ends 37A and 38A of the arms 37 and 38 being welded or otherwise suitably attached to the cross member 31 in the illustrated positions (defining a plane that is perpendicular to the axis of elongation 30C). The first and second arms 37 and 38 (e.g., twelve-inch long pieces of ¾-inch hollow square steel tubing) extend perpendicularly from the cross member 31 in parallel spaced-apart relationship to the lid-restricting piece 33 (e.g., a two-inch wide, thirteen-inch long piece of ⅜-inch thick steel plate) that is welded or otherwise suitably attached to the distal ends 37B and 38B of the arms 37 and 38. In addition, the proximal ends 32C and 32D of the two pivot-limiting pieces 32A and 32B (e.g., two-inch wide, twelve-inch long pieces of ⅜-inch thick steel plate) are welded or otherwise suitably attached to the cross member 31 so that the pivot-limiting pieces 32A and 32B extend away from the elongated member 30 and the cross member 31 parallel to the axis of elongation 30C.

Figure 3:
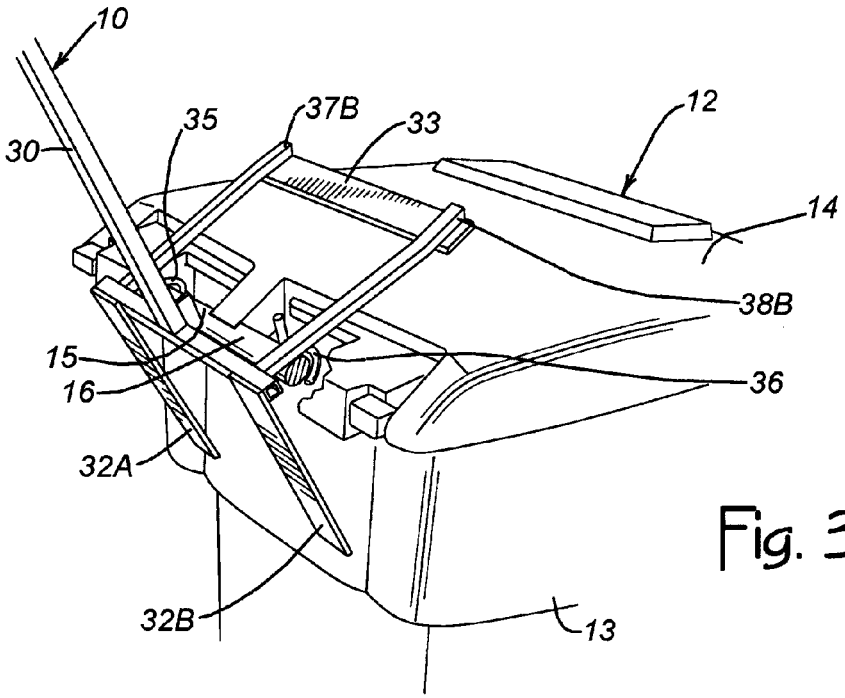
FIG. 3 is a perspective view of the apparatus of the present invention shown mounted on the pair of handles of the trash container.
Figure 4:
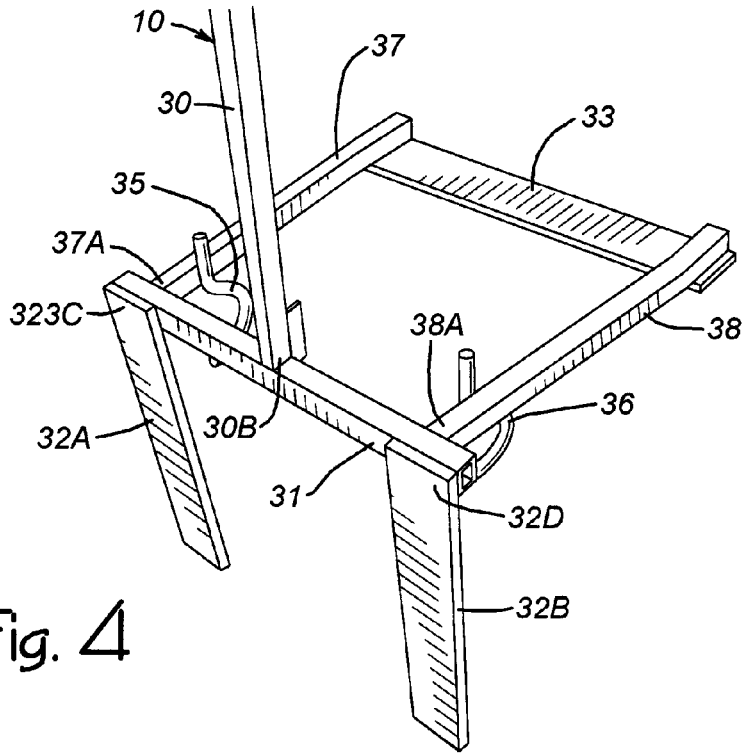
FIG. 4 is a perspective view, as viewed from a different angle, of just the second end portion of the elongated member and the attached components.

To use the apparatus 10, the user 11 attaches it to the handles 15 and 16 on the trash container 12 in the position shown in FIG. 3. FIG. 4 indicates the general orientation of the apparatus 10 as the user moves it down onto and into engagement of the handles 15 and 16 of the trash container 12. FIG. 6 is a cross section called out by a circular line 6-6 in FIG. 5 that more clearly identifies the hook 35 in relationship to the first handle 15. FIG. 6 is a cross section as viewed in a plane extending parallel to and intermediate the first and second arms 37 and 38. When mounted on the handles 15 and 16, the pivot-limiting pieces 32A and 32B contact the container component 13 and the lid-restricting arms 37 and 38 extend over the lid 14 as shown in FIGS. 5 and 6.

Figure 5:
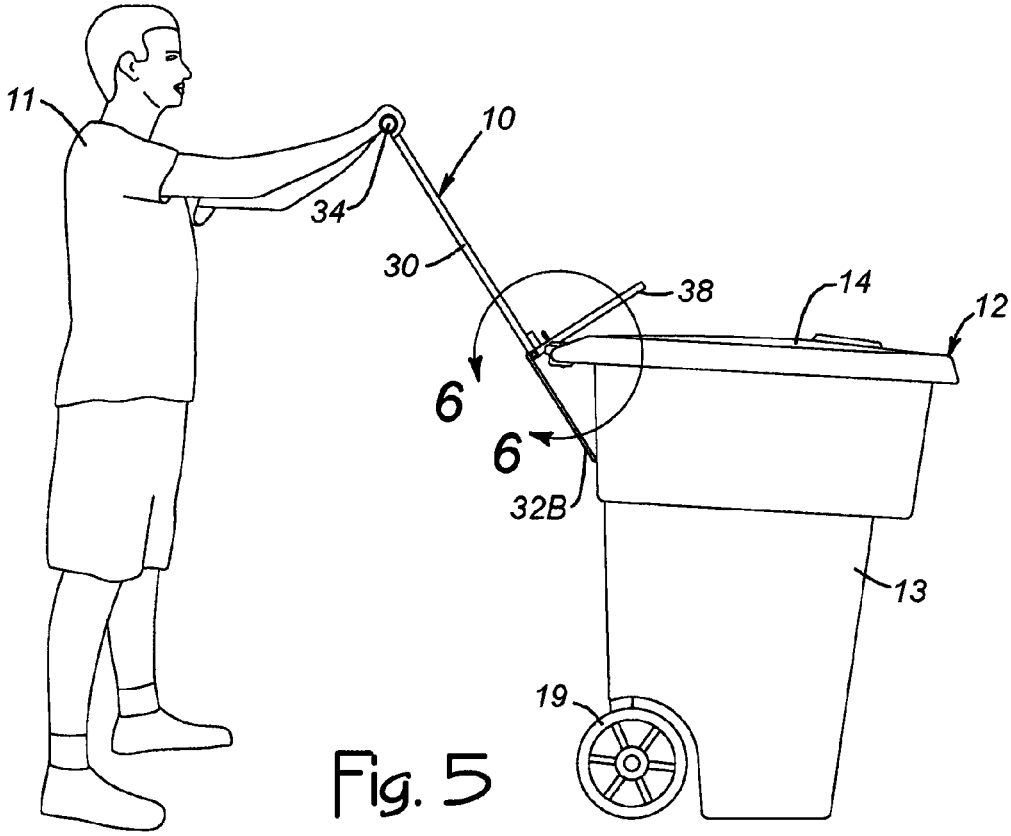
FIG. 5 is a diagrammatic side elevation view of a user holding the apparatus after mounting it on the pair of handles in preparation for tilting the trash container.
Figure 6:
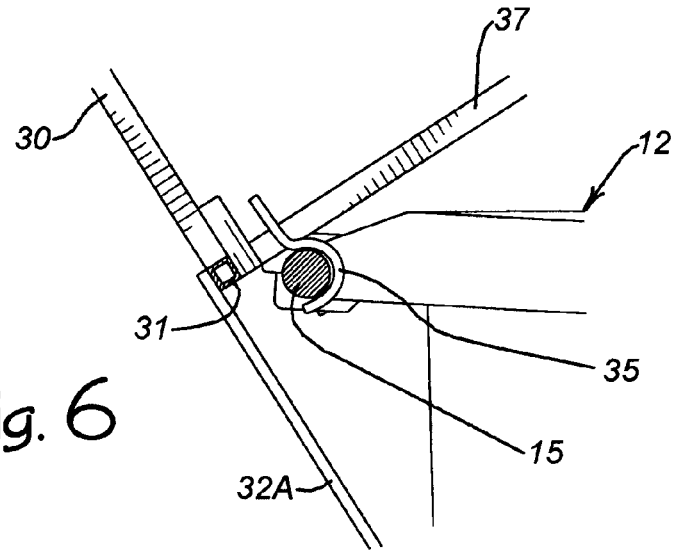
FIG. 6 is an enlarged detail view of a portion of FIG. 5 that is identified by the circular line 6-6 in FIG. 5.
Figure 7:
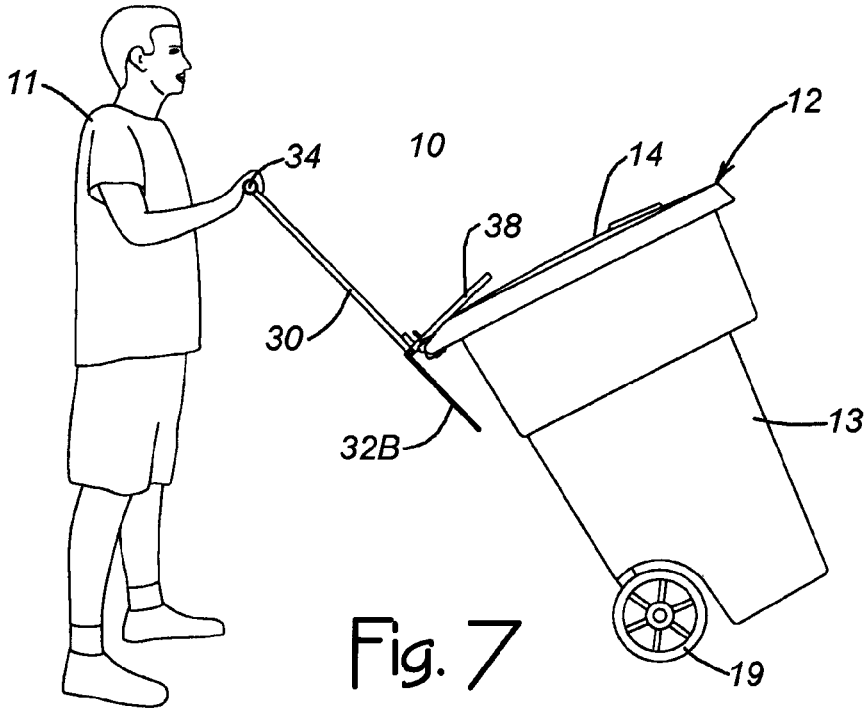
FIG. 7 is a diagrammatic side elevation view of the user tilting the trash container in preparation for moving it.
Figure 8:
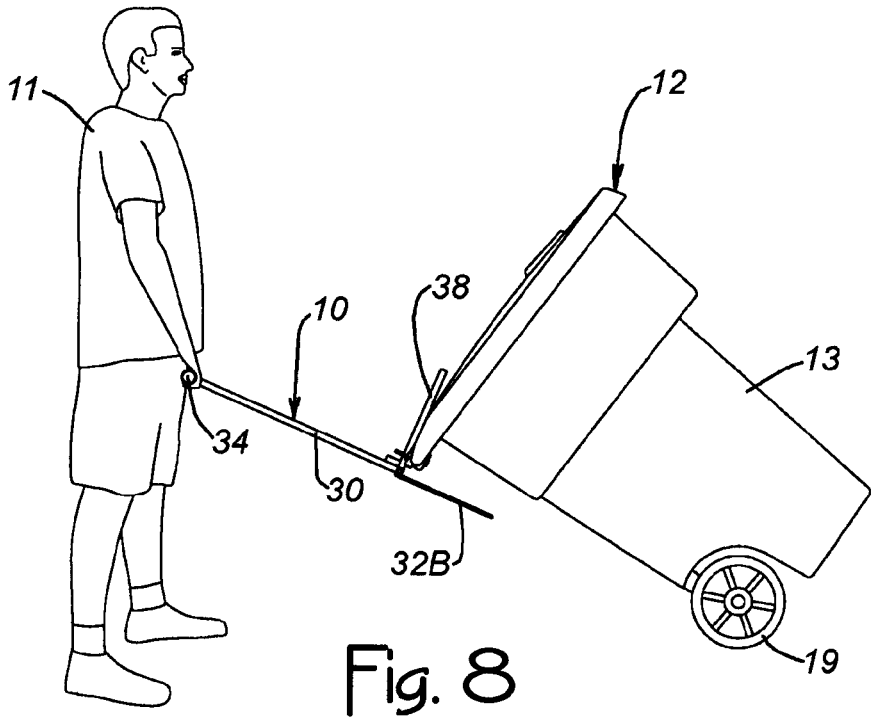
FIG. 8 is a diagrammatic side elevation view showing the trash container fully tilted and ready for manual movement to another location.

With the apparatus 10 attached to the handles 15 and 16 by the hooks 35 and 36, the user 11 grasps the handle member 34 on the first end 30A of the elongated member 30 as illustrated in FIG. 5. Next, the user 11 pulls the handle member 34 toward the user and downwardly in order to thereby tilt the trash container 12 about the wheels, only the wheel 19 being visible in FIGS. 7 and 8. As that occurs, the pivot-limiting pieces 32A and 32B initial bear against the container component 13 (as shown in FIG. 5), thereby assisting in the tilting operation. As tilting of the trash container 12 continues, however, the apparatus 10 pivots slightly about the handle axis 17 (identified in FIG. 2), with the result that the lid-restraining arms 37 and 38 move closer to the lid 14 where they restrain the lid 14 from falling toward the user 11. The user 11 then wheels the tilted trash container 12 to a desired location, as indicated in FIG. 8 (by pushing or pulling on the apparatus 10), and then lifts on the handle member 34 in order to pivot the trash container 12 back to an upright position. Thereafter, the user 11 removes the apparatus 10 from the trash container 12 and stores it for later use when needed.

The foregoing description makes the function of the various components more readily discernible. The handle member 34 on the first end 30A of the elongated member 30 functions as first means for enabling the user to grip the first end 30A container-tilting and container-moving purposes. The hooks 35 and 36 (and the related support structure) function as second means for enabling the user 11 to engage the pair of handles 15 and 16 on the container component 13 with the second end 30B of the elongated member 30 so that the central axis of elongation 30C of the elongated member 30 extends upwardly from the set of handles 35 and 36 as an extended lever arm for assisting the user 11 in the task of tilting and moving the trash container 12. The hooks 35 and 36 also help keep the apparatus 10 from separating from the handles 15 and 16 in use (e.g., when the trash container 12 is fully tilted and pull on). They inhibit upward movement of the apparatus 10 relative to the handles 15 and 16. In other words, the hooks also keep the apparatus 10 and the trash container locked together when in use to avoid the trash container falling apart from the apparatus 10. The pivot-limiting pieces 32A and 32B connected to the second end 30B of the elongated member 30 in a position extending downwardly away from the elongated member 30 where they can bear against the container component 13 in opposition to pivotal movement of the elongated member 30 about the handle axis 17, function as third means for restricting pivotal movement of the elongated member 30 about the handle axis 17 when the set of handles 15 and 16 are engaged by the hooks 35 and 36. And, the lid-restricting piece 33 connected to the second end 30B of the elongated member 30 (via the arms 37 and 38) in a position extending over at least a portion of the lid 14, functions (with the arms 37 and 38) as fourth means for restricting pivotal movement of the lid 14 as the user 11 tilts and manually moves the trash container 12 with the apparatus 10. It also restricts pivotal movement of the elongated member 30 about the handle axis 17 toward the lid 14. Based upon the foregoing and subsequent descriptions, one of ordinary skill in the art can readily implement an apparatus according to the present invention.

Constructed as described above, the apparatus 10 may also be described as an elongated "tool" having a "mid section," an "upper section," a "lower section," and a "lid-restricting section." The mid section of the apparatus 10 includes the second end 30B of the elongated member 30, the cross member 31, the proximal ends 32C and 32D of the two pivot-limiting pieces 32A and 32B, the proximal ends 37A and 38A of the two arms 37 and 38, and the two hooks 37 and 38. As such, the mid section of the apparatus 10 functions as means for engaging the pair of handles 15 and 16 on the trash container 12 for container-attachment purposes. The upper section of the apparatus 10 includes the rest of the elongated member 30 and the knurled handle member 34, extending upwardly from the mid section and functioning as a lever arm for the user 11 to grasp. The lower section of the apparatus 10 includes the rest of the pivot-limiting members 32A and 32B that extend downwardly from the mid section (beyond the proximal ends 32C and 32D). The lid-restricting section of the apparatus 10 extends outwardly.

Figure 9:
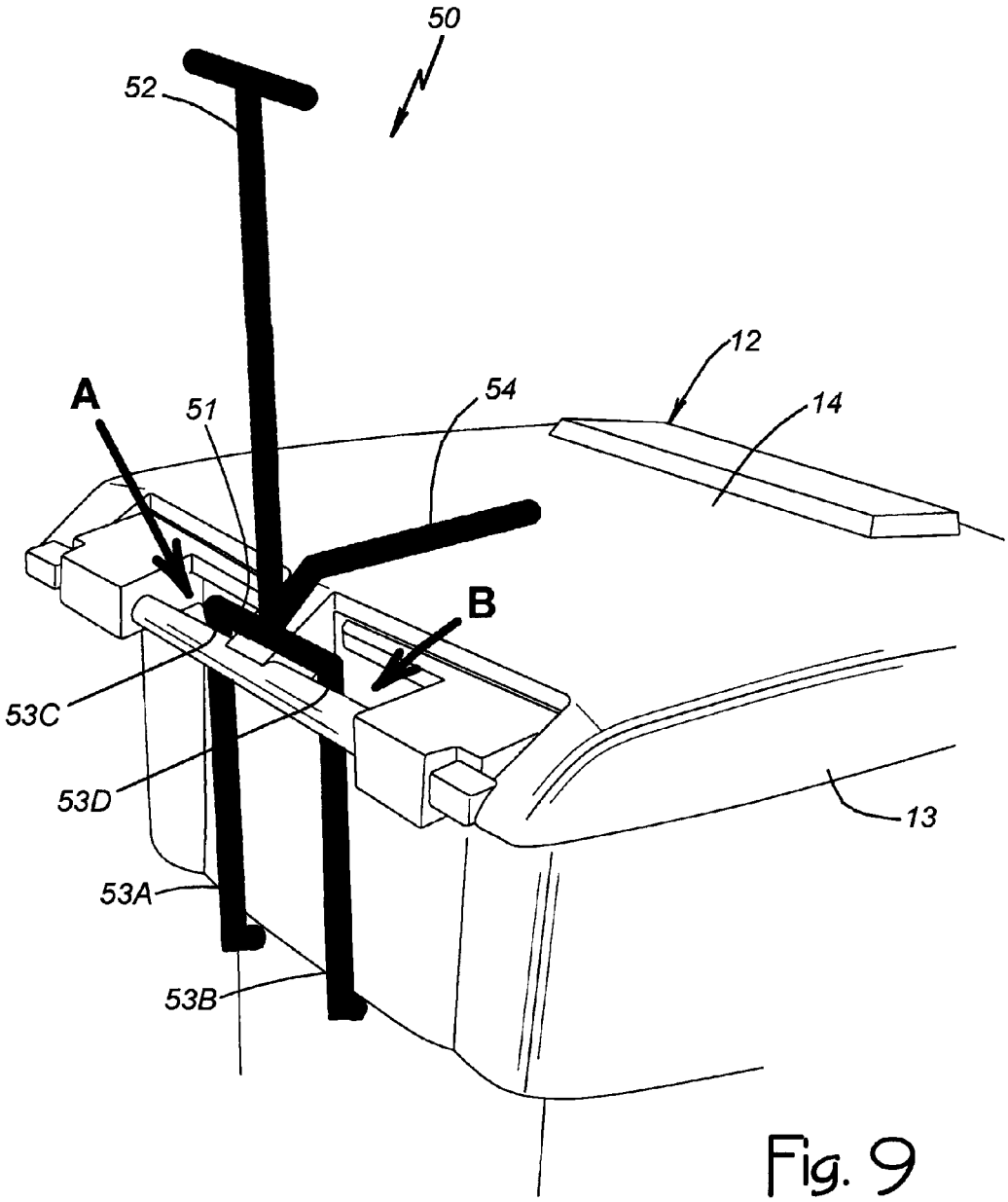
FIG. 9 is a diagrammatic view of a second embodiment of an apparatus constructed according to the invention in the form of a tool with a bifurcated mid section that extends behind the handles of the trash container for handle-engaging purposes.
Figure 10:
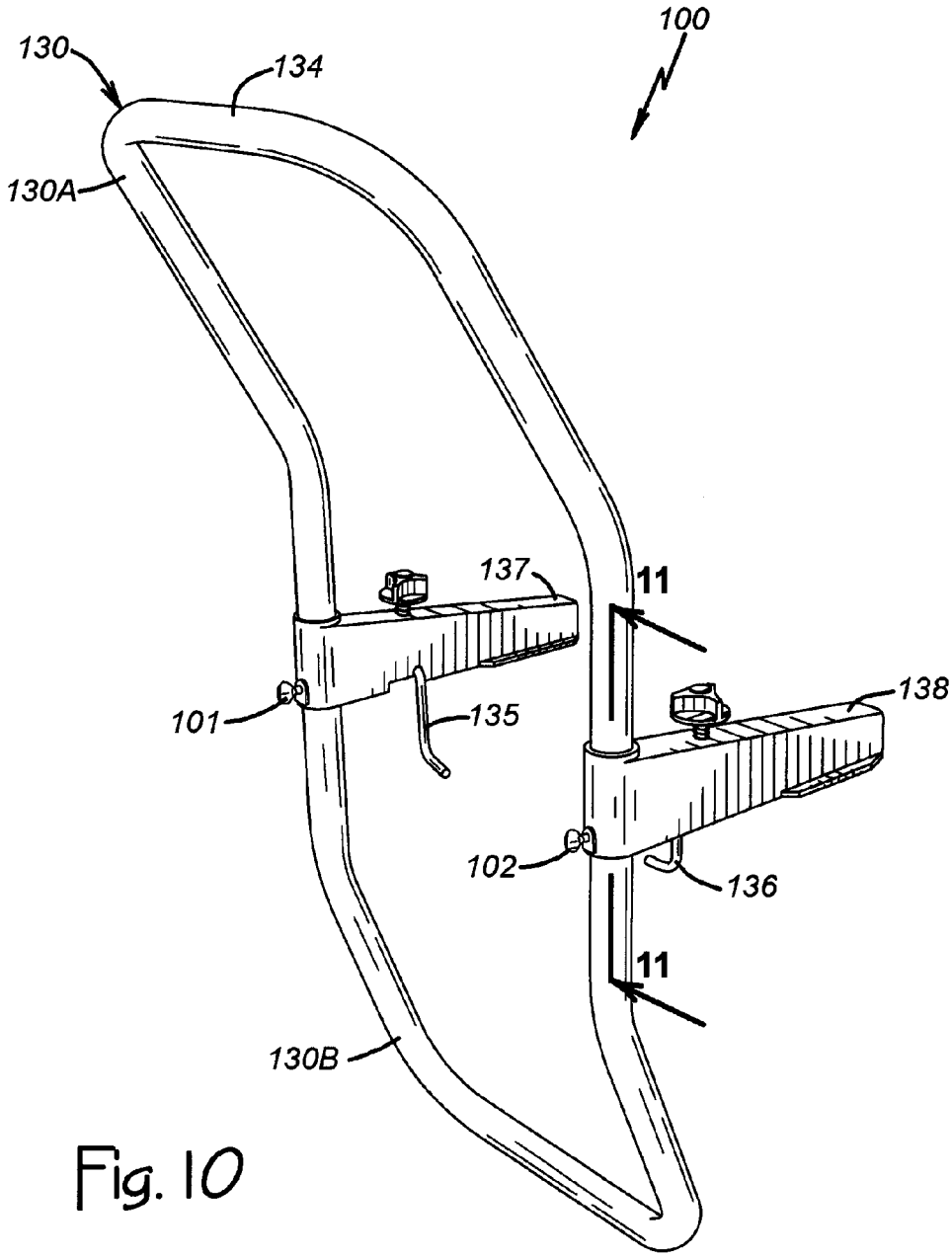
FIG. 10 is perspective view of a third embodiment of an apparatus constructed according to the invention.

FIG. 9 is a diagrammatic representation of a second embodiment of an apparatus constructed according to the invention in the form of a tool 50. Functionally, the tool 50 is similar to the apparatus 10 in that it engages the handles 15 and 16 as a lever arm that facilitates the task of tilting and moving the trash container 12. Similar to the apparatus 10, the tool 50 has a cross piece 51, an upwardly extending elongated member 52 connected to the cross piece 51, two downwardly extending pivot-limiting pieces 53A and 53B connected to the cross piece 51, and an over-the-lid-extending lid-restricting arm 54. Those parts are fabricated of suitably rigid material (e.g., steel), with the cross piece 51 and the proximal ends 53C and 53D of the pivot-limiting pieces 53A and 53B forming a "mid section" of the tool 50 that engages the handles of the trash container 12. The elongated member 52 is an upper section that provides a lever arm, while the pieces 53A and 53B are a lower section that contact the container component for pivot-limiting purposes.

Unlike the apparatus 10, however, the tool 50 includes a bifurcated mid section that engages the handles of the trash container 12 by extending through the spaces between the container component 13 and the handles on the trash container. Those spaces are identified in FIG. 9 with large bold letters and arrows as a space A and a space B. The mid section is bifurcated (i.e., forked) in that it splits into two branches, namely, the proximal end portions 53C and 53D of the pivot-limiting pieces 53A and 53B. The proximal end portions 53C and 53D are sized and shaped to extend through the spaces A and B so that in operation of the tool 50, they bear against the handles and in that way engage the handles. The handles are not identified with leadlines and numerals in FIG. 9 in order to keep FIG. 9 uncluttered. Reference should be made to FIG. 2 for the handle identification and identification of the various other parts of the existing trash container 12. Based upon the foregoing descriptions, one of ordinary skill in the art can readily implement the tool 50 with suitable gripping features so that the "mid section" of the tool 50 and/or the pivot-limiting pieces and/or other parts help prevent the tool from separating from the handles while in use.

FIGS. 10 through 18 show various aspects of third embodiment of the invention that is identified as a tool 100. The tool 100 is similar in many aspects of structure and function to the apparatus 10, and so only differences are described in further detail. For convenience, reference numerals identifying parts of the tool 100 are increased by one hundred over those identifying similar, associated, or related parts of the apparatus 10.

Figure 11:
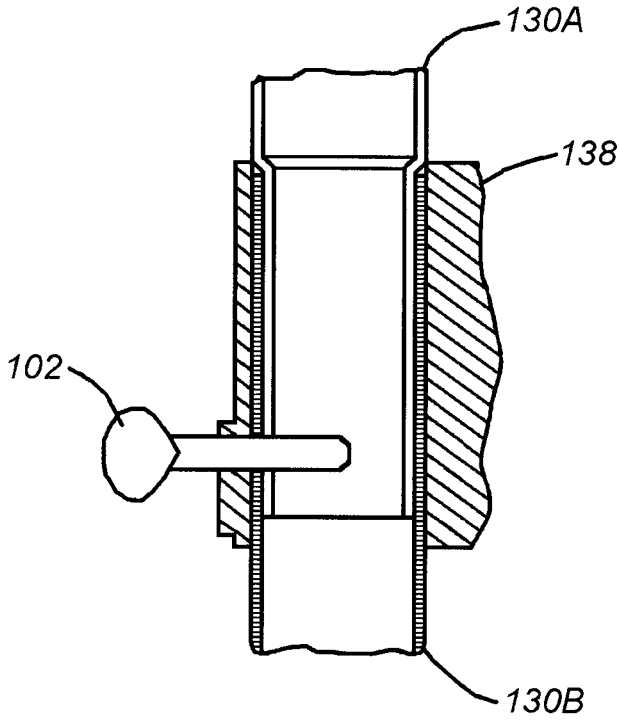
FIG. 11 is an enlarged cross section of a coupling portion of the third embodiment as viewed in a plane containing a line 11-11 in FIG. 10.
Figure 12:
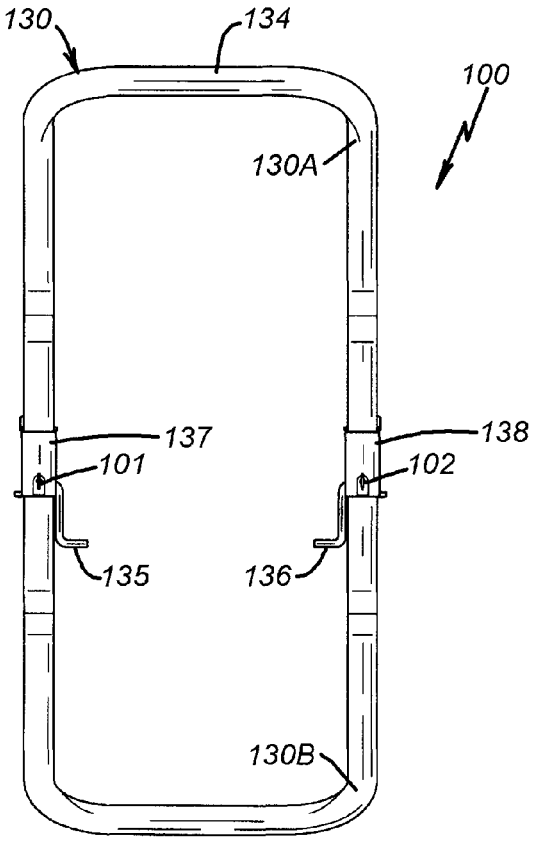
FIG. 12 is a back elevation view of the third embodiment.
Figure 13:
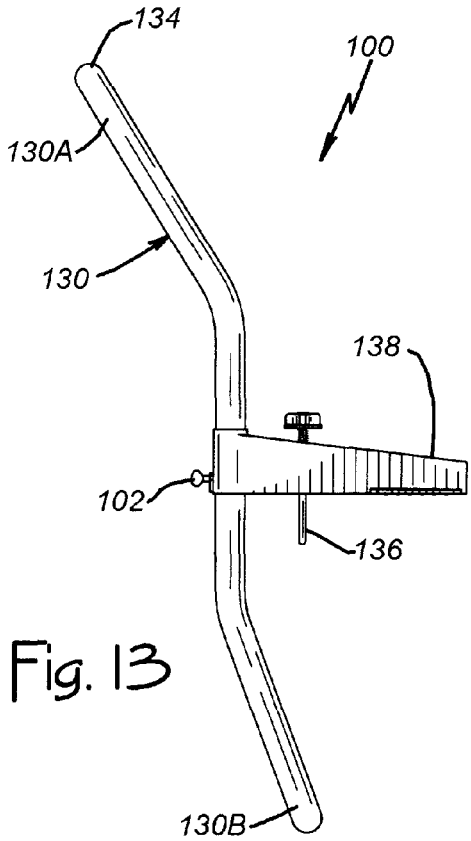
FIG. 13 is right side elevation view of the third embodiment.
Figure 14:
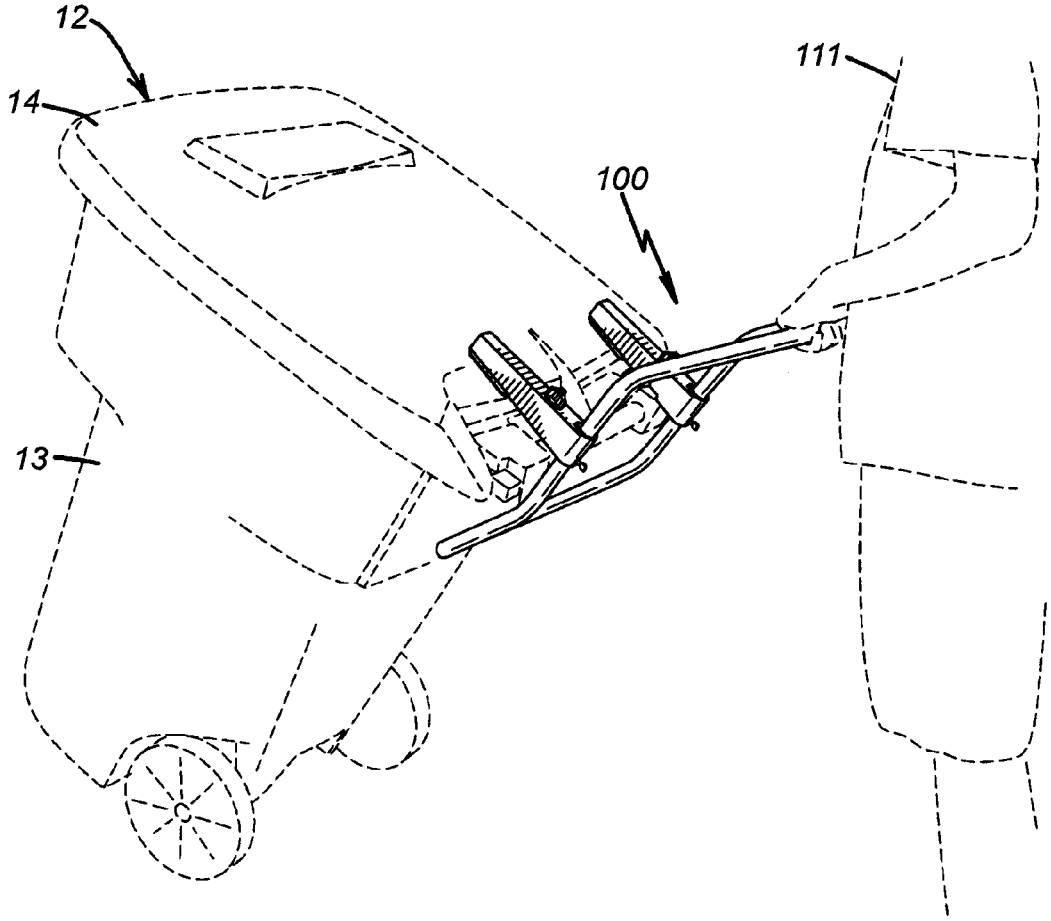
FIG. 14 is perspective view of the third embodiment in its usual environment, showing a person using the apparatus to move a typical trash container.
Figure 15:
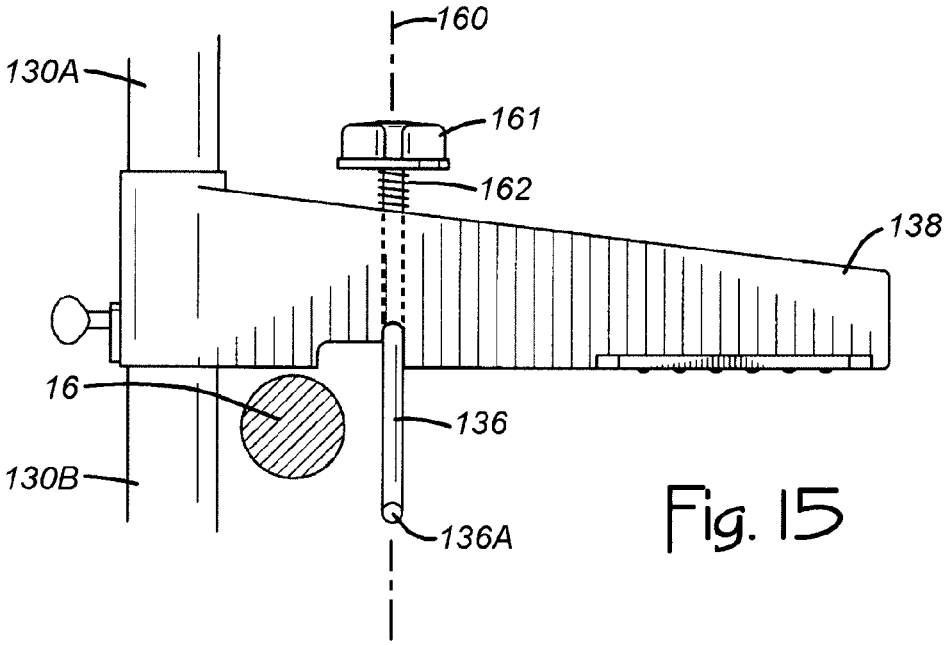
FIG. 15 is an enlarged portion of the third embodiment with the mid section in position to engage the handle of the trash container.

First consider FIGS. 10-14. The tool 100 has an elongated member 130 that includes an upper portion 130A with a handle 134, and a lower portion 130B. The upper and lower portions 130A and 130B are coupled together with joints that include respective ones of a left arm 137 and a right arm 138 (FIGS. 10, 12, 13, and 14). The upper and lower portions 130A and 130B are formed from lengths of one-inch outside diameter metal tubing (e.g., steel) that are bent into the illustrated configurations. The ends of those two lengths of steel tubing are assembled telescopingly within the left and right arms 137 and 138 using threaded thumb screws 101 and 102. The manufacturer screws the thumb screws 101 and 102 into threaded holes (not shown) to secure the ends of the two lengths of steel tubing in place within through-bores extending through the left and right arms 137 and 138. FIG. 11 is an enlarged cross section of the rightside joint that includes the right arm 138; the leftside joint is similar. So constructed, the illustrated elongated member 130 is about 31 inches in overall length and about 13¼ inches in overall width measured along a straight line extending between the thumb screws 101 and 102. Of course, those dimensions may vary without departing from the inventive concepts disclosed.

The illustrated left and right arms 137 and 138 are plastic components measuring about 1 3/16 inches thick (along a straight line extending between them) and about 9½ inches long (along a line perpendicular to the elongated member 130). They support respective ones of hook members 135 and 136 (FIGS. 10-12) that are formed from lengths of ¼-inch diameter steel rod. Using terminology introduced previously, the tool 100 may also be described as an elongated "tool" having a "mid section," an "upper section," a "lower section," and a "lid-restricting section." The upper section includes the upper portion 130A of the elongated member 130. The lower section includes the lower portion 130B of the elongated member 130. The mid section includes the coupled ends of the upper and lower 130A and 130B of the elongated member 130, along with the coupling portion of the left and right arms 137 and 138 and the hook members 135 and 136, and the lid-restricting section includes the rest of the left and right arms 137 and 138. A user 111 (FIG. 13) uses the tool 100 in much the same way described previously for the apparatus 10, after first hooking the hook members 135 and 136 on respective ones of the left and right handles 15 and 16. The various sections of the tool 100 function as described above for the apparatus 10.

FIGS. 15-18 provide further details of the hook members 135 and 136. Unlike the hook members 35 and 36 of the apparatus 10, the hook members 135 and 136 of the tool 100 are pivotable in order to facilitate mounting of the tool 100 on the trash container 12. The hook members 135 and 136 are similar to each other, however, and so only the hook member 136 is illustrated in FIGS. 15-18 and described in further detail. It is shown in a first hook position in FIG. 15, in a second hook position in FIG. 16, in a third hook position in FIG. 17, and in a fourth hook position in FIG. 18. The user places the tool 100 adjacent the handle 16 so that the elongated member extends vertically rearward of the handle 16 and the hook member 136 extends downwardly between the handle 16 and the container component 13. Then, the user manipulates the hook member 136 sequentially through the first, second, third, and fourth hook positions in order to engage the right handle 16. Disengagement proceeds in reverse order.

To enable that action, the hook member 136 is mounted in a through-bore in the right arm 138 that extends along a through-bore axis 160 that is also a hook axis of elongation along which the upper portion (i.e., a straight shank portion) of the hook component extends. The upper straight shank portion of the hook member 136 extends coaxially along the through-bore axis 160 to a knob 161 that is screwed onto a terminal end portion of the upper straight shank portion. A spring 162 biases the knob 161 (and the upper straight shank portion) upwardly away from the right arm 138 so that a lower portion of the hook member 136 seats in a depression 163 provided for that purpose. That is the first hook position, a position in which a lower tip portion 136A of the hook member 136 is generally parallel to the handle 16 (i.e., the handle axis 17). The depression 163 is identified in FIGS. 16 and 18.

Figure 16:
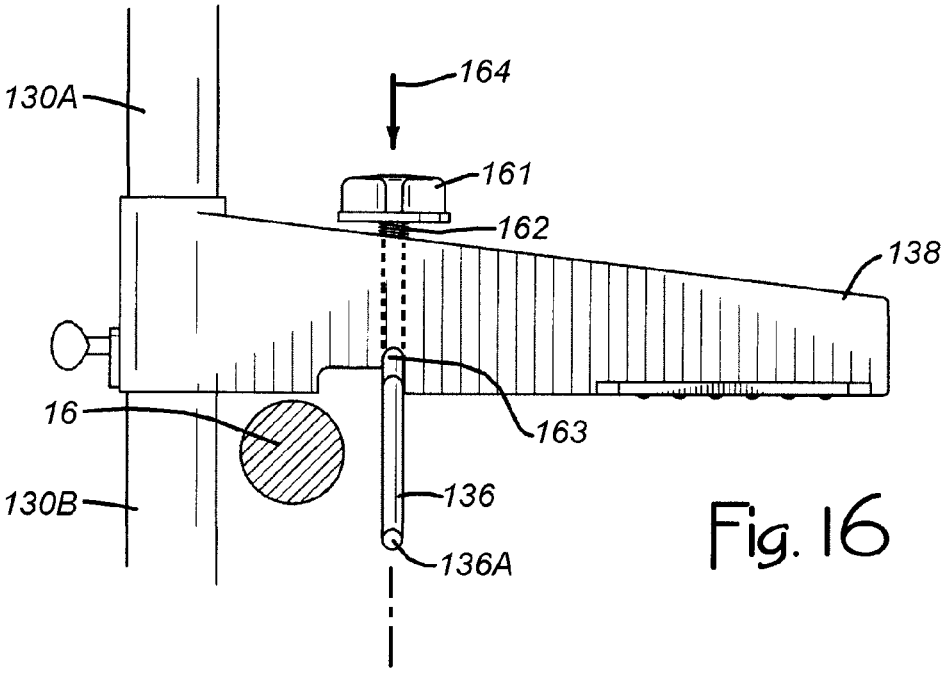
FIG. 16 shows the enlarged portion with the hook member depressed in preparation for engaging the handle.
Figure 17:
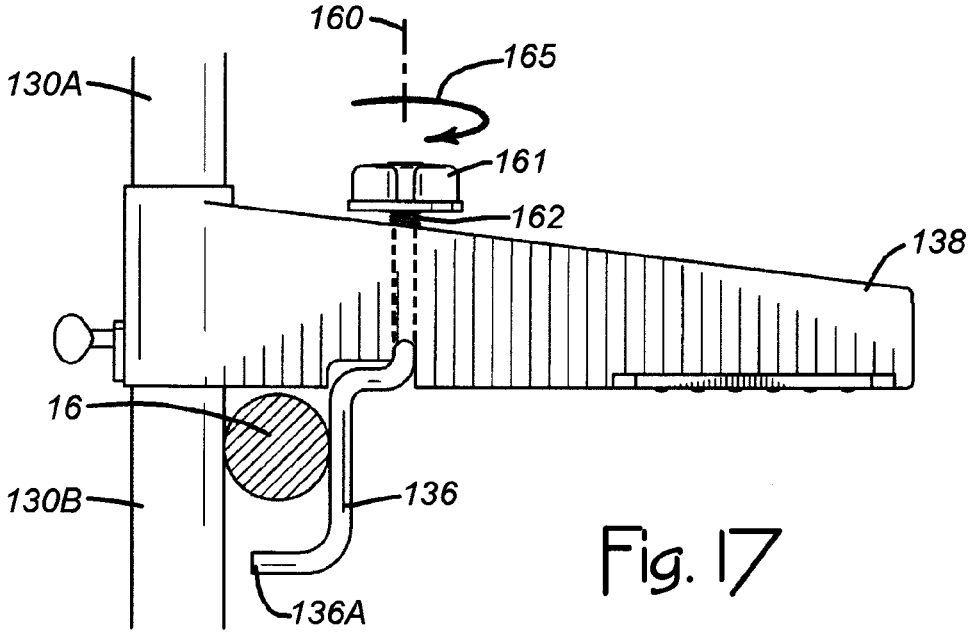
FIG. 17 shows the hook member after it has been pivoted ninety degrees.
Figure 18:
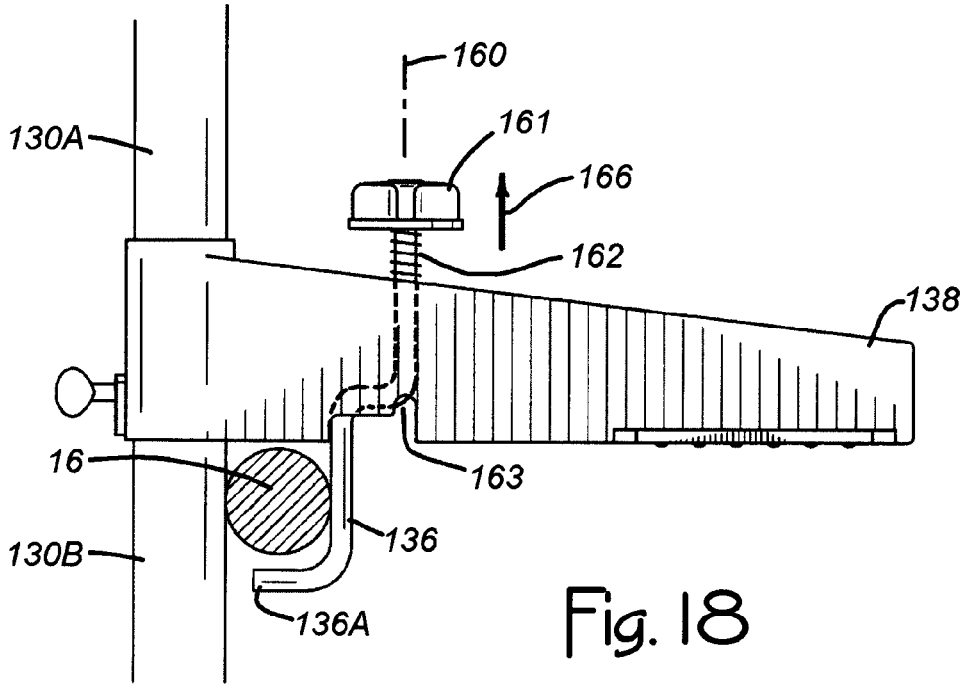
FIG. 18 shows the hook member engaging the handle after the hook member has been released.

To engage the handle 16 with the hook member 136, the user applies downward force to the knob 161 as depicted by an arrow 164 in FIG. 16. That frees the lower portion of the hook member 136 from the depression 163 and places the hook member 136 in the second hook position shown in FIG. 16. Next, while holding the knob 161 downwardly, the user pivots the hook member 136 ninety degrees by turning the knob 161 ninety degrees about the through bore axis 160, as depicted by an arrow 165 in FIG. 17. Doing so moves the hook member 136 to the third hook position. After that, the user releases downward force on the knob 161 so that the hook member 136 is free to move upwardly under influence of the spring 162 to the fourth hook position, as depicted by an arrow 166 in FIG. 18, a position in which the lower tip portion 136A of the hook member 136 is beneath and generally perpendicular to the handle 16 (i.e., the handle axis 17) so that it inhibits upward movement of the tool 100 relative to the handle 16.

Thus, the invention provides an apparatus that significantly facilitates manual trash can tilting and moving. Although exemplary embodiments have been shown and described, one of ordinary skill in the art may make many changes, modifications, and substitutions without necessarily departing from the spirit and scope of the invention. Any of various materials may be used for the apparatus, for example, including metal and plastic. As for the specific terminology used to describe the exemplary embodiments, it is not intended to limit the invention; each specific term is intended to include all technical equivalents that operate in a similar manner to accomplish a similar purpose or function. The expressions upper, lower, and the like, for example, refer to spatial orientations when the apparatus is mounted in a operative position on the handles of a trash container that is in an upright position on level ground or other horizontal support surface.

What is claimed is:

1. An apparatus for facilitating manual movement of a trash container having an upwardly opening container component, a lid attached atop the container component by a hinge arrangement, a pair of handles on the container component in spaced-apart relationship to each other along a horizontally extending handle axis, and a set of wheels on the container component such that a user can grasp the pair of handles and tilt the container component on the set of wheels for purposes of manually moving the trash container, the apparatus comprising:

an elongated tool for the user to attach to the pair of handles of the trash container for container-moving purposes;

a mid section of the tool that functions as means for engaging the pair of handles for container-attachment purposes;

an upper section of the tool that functions as a lever arm for the user to grasp, said upper section extending upwardly from the mid section;

a lower section of the tool that functions as means for opposing pivotal movement of the tool about the handle axis, said lower section extending downwardly from the mid section alongside the container component in a position to contact the container component in opposition to pivotal movement of the tool about the handle axis; and a lid-restraining section of the tool that functions as means for restraining pivotal movement of the lid about the hinge arrangement, said lid-restraining section extending from the mid section over at least a portion of the lid;

wherein the mid section of the tool includes a set of hooks for hooking the pair of handles, and said set of hooks are pivotable to facilitate hooking of the pair of handles;

whereby the user can attach the tool to the trash container, grasp the upper section, and tilt the trash container on the set of wheels for container-moving purposes.

* * * * *